United States Patent [19]

Suka et al.

[11] Patent Number: 4,809,394

[45] Date of Patent: Mar. 7, 1989

[54] VACUUM CLEANER HAVING A BLOWER FACILITY STRUCTURE

[75] Inventors: Hisao Suka, Hitachi; Akira Iwao, Kitaibaraki; Kazuhiro Kubota, Hitachi; Yoshitaro Ishii, Hitachi; Masao Sunagawa, Hitachi, all of Japan

[73] Assignee: Hitachi, Ltd., Tokyo, Japan

[21] Appl. No.: 91,602

[22] Filed: Aug. 31, 1987

[30] Foreign Application Priority Data

Aug. 29, 1986 [JP] Japan ..... 61-201451

[51] Int. Cl.[4] ..... A47L 5/14

[52] U.S. Cl. ..... 15/327 R; 15/327 E; 15/330

[58] Field of Search ..... 15/327 E, 327 F, 327 R, 15/328, 330

[56] References Cited

U.S. PATENT DOCUMENTS

| | | | |
|---|---|---|---|
| 2,174,595 | 10/1939 | Pierce | 15/330 X |
| 3,334,370 | 8/1967 | Boyd | 15/330 |
| 3,731,465 | 5/1973 | Ohira et al. | 15/327 E |
| 3,816,983 | 6/1974 | Sawada et al. | 15/327 E |
| 4,225,999 | 10/1980 | Martinec et al. | 15/330 |
| 4,299,007 | 11/1981 | Hug | 15/327 R |
| 4,586,214 | 5/1986 | Berfield | 15/327 F |
| 4,592,764 | 6/1986 | Ikezaki et al. | 15/327 E |
| 4,705,547 | 11/1987 | Rotola et al. | 15/327 E |

FOREIGN PATENT DOCUMENTS

| | | | |
|---|---|---|---|
| 0003269 | 1/1977 | Japan | 15/327 R |

*Primary Examiner*—Harvey C. Hornsby
*Assistant Examiner*—Corinne M. Reinckens
*Attorney, Agent, or Firm*—Antonelli, Terry & Wands

[57] ABSTRACT

A vacuum cleaner with panel portion structure which includes an improved panel main body and a blower facility valve body. The panel main body has an exhaust air port and an opening for a blower facility. The blower facility valve body is provided at a lower side of the panel main body and is rotatably supported so as to normally shut the blower facility opening. A first exhaust air passage is formed between the intermediate exhaust air port to the main body exhaust air port. A second exhaust air passage is formed between the intermediate exhaust air port to the blower facility opening. The first exhaust air passage and the second exhaust air passage are changed over by the blower facility valve body. The improved blower facility structure permits the development of a series of vacuum cleaners with and without a blower facility.

9 Claims, 8 Drawing Sheets

VACUUM CLEANER HAVING A BLOWER FACILITY STRUCTURE

BACKGROUND OF THE INVENTION

The present invention relates to a vacuum cleaner having a blower facility structure and, more particularly, relates to a vacuum cleaner having a blower facility structure including an improved exhaust air passage structure suitable for the blower facility structure.

There are two kinds of conventional vacuum cleaners, one of which has a blower facility structure and another of which does not have a blower facility structure. In such conventional vacuum cleaners, the vacuum cleaner having the blower facility structure is not capable of being used as part of a line or series which includes vacuum cleaners without the blower facility structure.

A vacuum cleaner having a blower facility structure is proposed in, for example, Japanese Utility Model Laid-Open No. 2847/1986. The vacuum cleaner has a dispersion exhaust air port and a concentration exhaust air port for the blower facility function. The concentration exhaust air port is positioned upstream of the dispersion exhaust air port. Both the dispersion exhaust air port and the concentration exhaust air port are installed at the rear portion of the vacuum cleaner main body. A lid is provided within the vacuum cleaner mai body so as to normally close the concentration exhaust air port by means of a spring member.

SUMMARY OF THE INVENTION

An object of the present invention is to provide a vacuum cleaner wherein an improved blower facility structure can be installed in the vacuum cleaner.

Another object of the present invention is to provide a vacuum cleaner wherein an improved exhaust air passage structure suitable for a blower facility structure can be obtained.

A further object of the present invention is to provide a vacuum cleaner having a blower facility structure wherein different kinds of vacuum cleaners as part of a series or complete family can be easily developed.

In accordance with the present invention, a vacuum cleaner having a blower facility structure comprises a main body case in which a motor driven blower mechanism and a cord reel mechanism are installed therein, a dust case with a dust collector apparatus installed therein, and a panel portion structure provided on the main body case.

The panel portion structure includes a panel main body member and a blower facility valve body member. The panel main body member has a main body exhaust air port and an opening for the blower facility. The blower facility valve body member is provided at a lower side of the panel main body member and supported rotatively so as to close normally the blower facility opening of the panel main body member.

A first exhaust air passage is formed to flow from the exhaust air passage from the motor driven blower mechanism to the main body exhaust air port, a second exhaust air passage is formed to flow from the exhaust air passage from the motor driven blower mechanism to the blower facility opening, and the first exhaust air passage and the second exhaust air passage are changed over by the blower facility valve body member.

A partition wall portion having an intermediate exhaust air port is provided in the upper main body case.

The intermediate exhaust air port is provided at an intermediate portion of the exhaust air passage from the motor driven blower mechanism.

A first exhaust air passage is formed to flow from the intermediate exhaust air port from the motor driven blower mechanism to the maid body exhaust air port, a second exhaust air passage is formed to flow from the intermediate exhaust air port from the motor driven blower mechanism to the blower facility opening, and the first exhaust air passage and the second exhaust air passage are changed over by the blower facility valve body member.

The intermediate exhaust air port has a lattice-like form. An opening area of the lattice-like intermediate exhaust air port is set to be smaller than an opening area of the main body exhaust air port.

According to the present invention, in a vacuum cleaner having a blower facility structure, an improved blower facility structure can be installed to allow easier development of a series or family of different kinds of vacuum cleaner.

DESCRIPTION OF THE PRESENTLY PREFERRED EMBODIMENT

Figure 1:
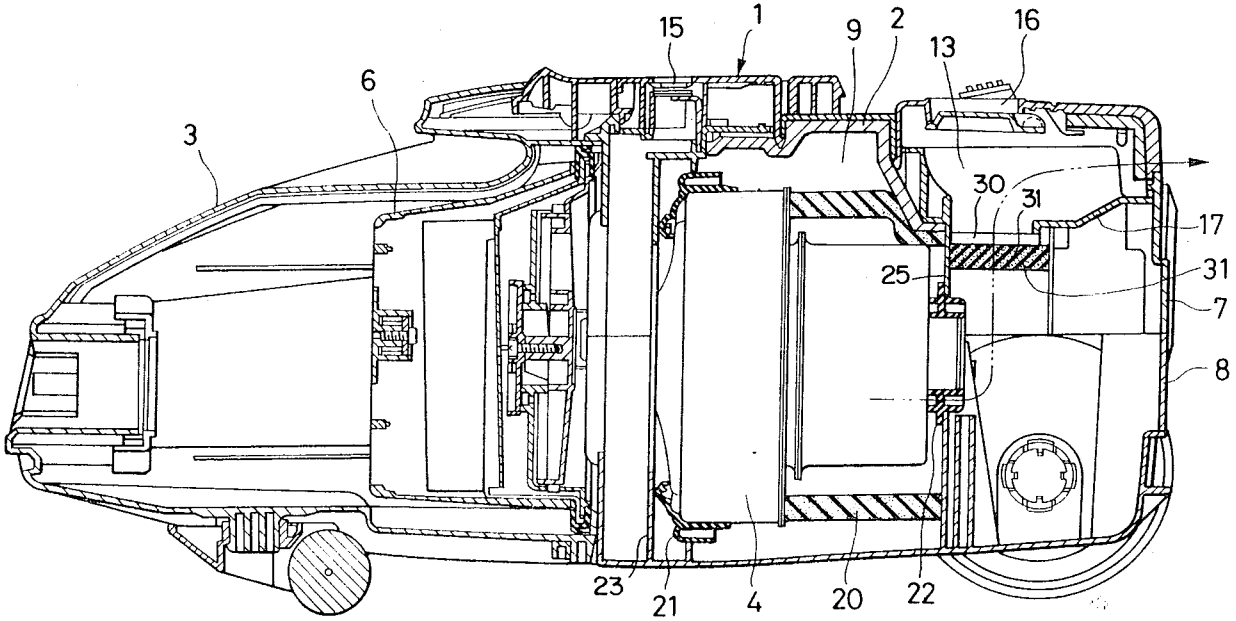
FIG. 1 shows a longitudinal cross-sectional view of a vacuum cleaner having the blower facility structure according to one embodiment of the present invention.
Figure 2:
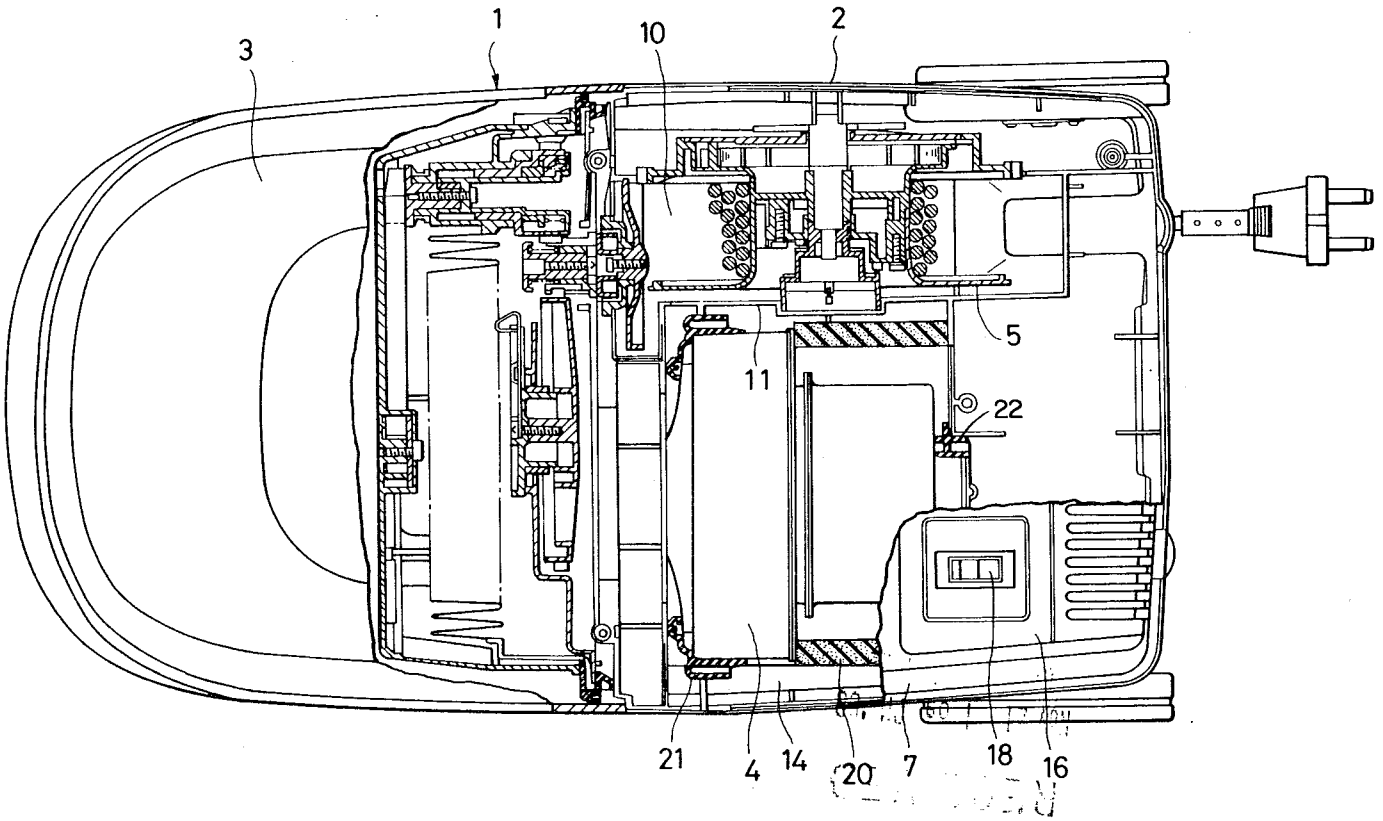
FIG. 2 shows a partial cross-section plan view of the vacuum cleaner having the blower facility structure of the present invention.
Figure 3:
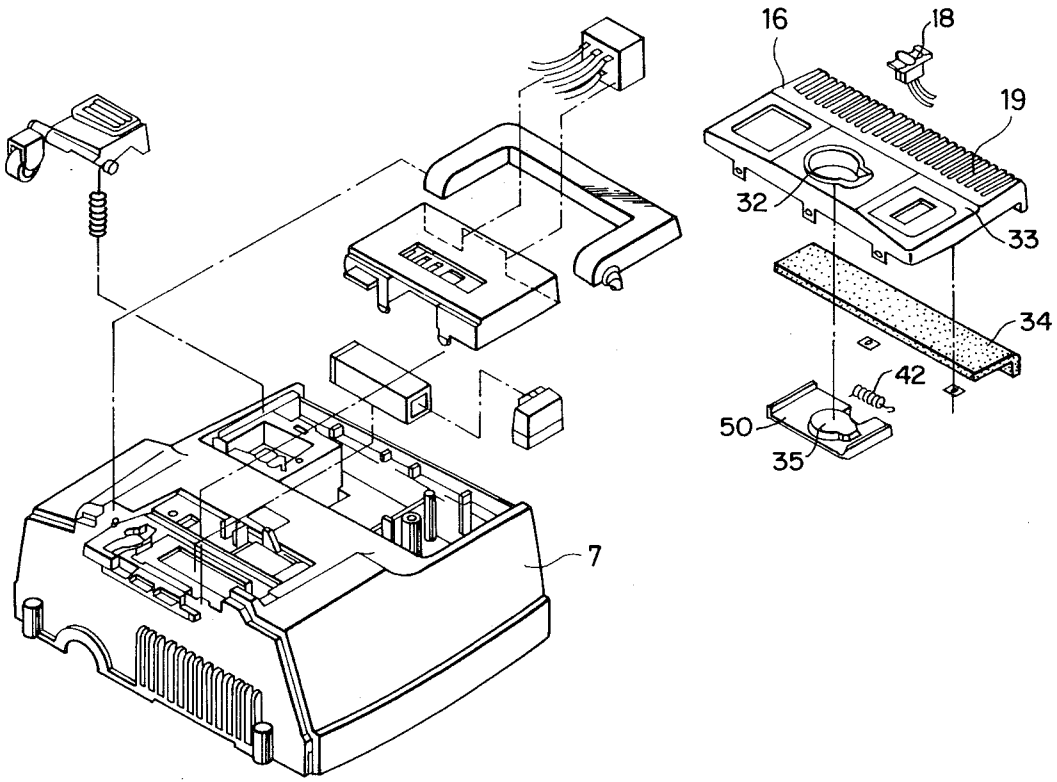
FIG. 3 shows an exploded perspective view of the upper main body case of the vacuum cleaner.
Figure 4:
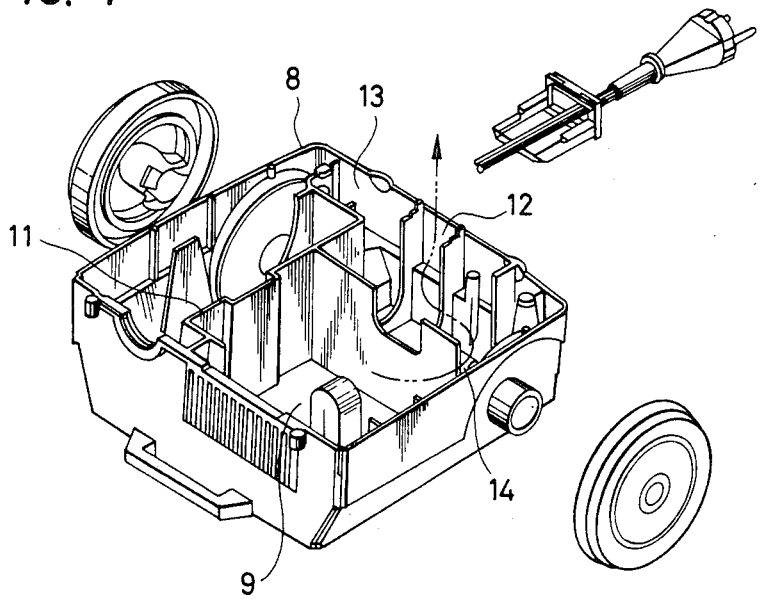
FIG. 4 shows an exploded perspective view of the lower main body case of the vacuum cleaner.

With reference to FIGS. 1 and 2, a vacuum cleaner 1 of the present invention includes a main body case 2 and a dust case 3. The main body case 2 has a motor driven blower mechanism 4 and a cord reel mechanism 5 installed therein. The dust case 3 also has a dust collector apparatus 6 installed therein.

The main body case 2 is divided into an upper main body case 7 made of synthetic resin and a lower main body case 8 made of synthetic resin. A motor driven blower receiving chamber 9 and a cord reel receiving chamber 10 are provided in the main body case 2. The motor driven blower mechanism 4 is installed within the motor driven blower receiving chamber 9 and the cord reel mechanism 5 is installed within the cord reel receiving chamber 10, respectively.

The main body case 2 has an integral intermediate wall portion 11 provided between the motor driven blower receiving chamber 9 and the cord reel receiving chamber 10 and separates these two chambers. The intermediate wall portion 11 prevents high temperature exhaust air from the motor driven blower receiving chamber 9 from flowing into the cord reel receiving chamber 10.

A concentration exhaust air chamber 12 and an exhaust air chamber 13 are provided at the rear portion of the motor driven blower receiving chamber 9. The motor driven blower receiving chamber 9 and the concentration exhaust air chamber 12 communicate with an exhaust air passage 14. A dust indicator member 15 is provided on the upper portion of the upper main body case 7 and communicates the front portion of an inhalation port of the motor driven blower mechanism 4 with a communicating pipe.

A panel portion structure 16 is provided on the upper main body case 7 and surrounds a partition wall portion 17 between the exhaust air chamber 13 and the exhaust air passage 14. A power source switch 18 is installed by snap fitting on a panel main body 33 of the panel portion structure 16. A main body exhaust air port 19 is provided on a side of the panel main body 33 of the panel portion structure 16. A filter member 20 made of, for example, urethane foam is provided within the main body exhaust air port 9 so as to remove fine dust, reduce the exhaust air noise and make the exhaust air flow velocity uniform.

Figure 5:
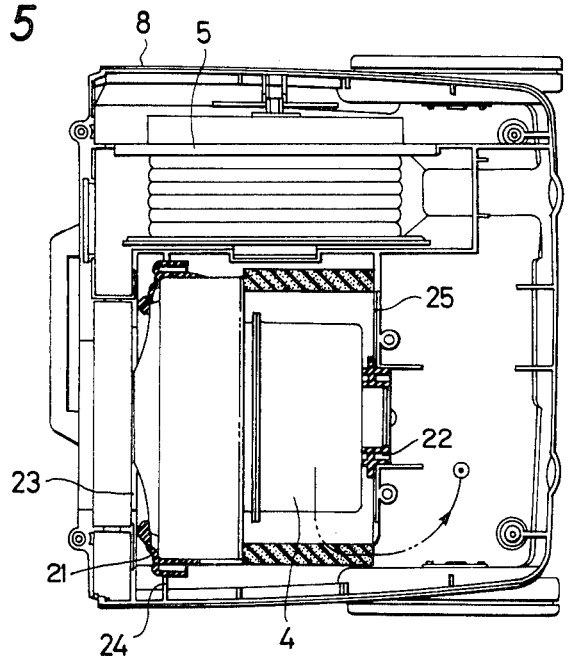
FIG. 5 shows a plan view of the lower main body case of the vacuum cleaner.
Figure 6:
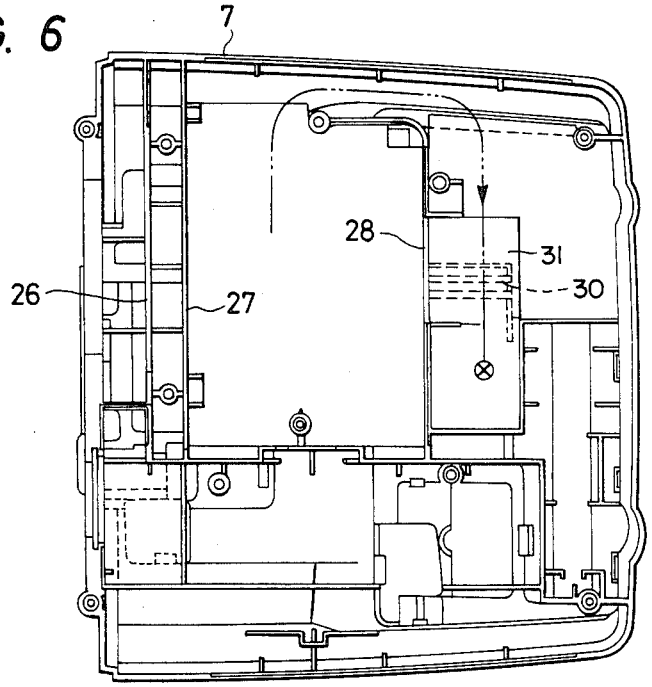
FIG. 6 shows a plan view of the upper main body case of the vacuum cleaner.
Figure 7:
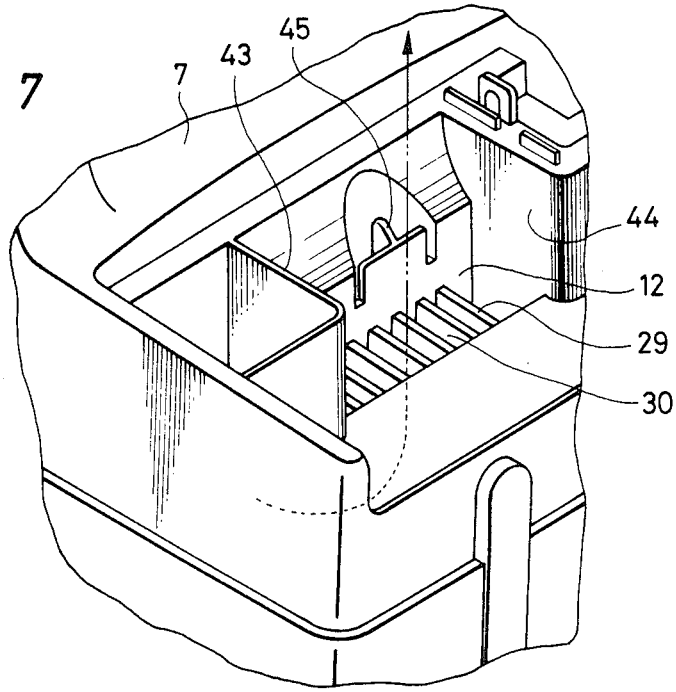
FIG. 7 shows a perspective view of a portion of the upper main body case of the vacuum cleaner.

FIG. 5 shows the assembled lower main body case 8, in which both of the motor driven blower mechanism 4 and the cord reel mechanism 5 are in the lower main body case 8, which is then coupled with the upper main body case 7. FIG. 6 shows the upper main body case 7 which is to be coupled with the lower main body case 8 shown in FIG. 5.

A front vibration-damping rubber member 21 and a rear vibration-damping rubber member 22 are fitted on both sides of the motor driven blower mechanism 4, respectively, as shown in FIGS. 1 and 2. The motor driven blower mechanism 4 is sandwiched and fixed as shown in FIG. 5 by means of a front portion receiving rib 23, a circular ring-shaped rib 24 and a rear portion receiving rib 25, which are integral with the lower main body case 8. The front portion of the front vibration damping rubber member 21 contacts the front portion receiving rib 23, so that the space between the intake air side and the exhaust air side of the motor driven blower mechanism 4 is maintained airtight.

In the upper main body case 7 shown in FIG. 6, a front portion receiving rib 26, a circular ring-shaped rib 27 and a rear portion receiving rib 28 supporting the motor driven blower mechanism 4 are integral with on upper main body case 7 in a manner similar to that of the lower main body case 8 shown in FIG. 5. However, the rear portion receiving rib 28 provided on the upper main body case 7 is bent toward the front portion side of the vacuum cleaner 1 to cover the outside of the filter member or the sound absorbing cover member 20 which is made of gas permeable urethane form.

The exhaust air from the motor driven blower mechanism 4 passes through the sound absorbing cover member 20 and goes through between the rear portion receiving ribs 25 and 28 and the case side wall, and thereafter around the rear sides of the rear portion receiving ribs 25 and 28.

The shapes of the rear portion receiving ribs 25 and 28 are different in the upper main body case 7 and in the lower main body case 8. The flow resistance to the exhaust air is larger because the rear portion receiving rib 28 provided on the upper main body case 7 is bent toward the front portion side. Therefore, there is less resistance to the exhaust air flow more into the lower main body case 8. Accordingly, the exhaust air noise diffusion toward the upper direction of the vacuum cleaner 1 is reduced.

The exhaust air travelling around the rear sides of the rear portion receiving ribs 25 and 28 passes through a lattice-like intermediate exhaust air port 30 having a lattice 29 and thereafter reaches the concentration exhaust air chamber 12. The lattice-like intermediate exhaust air port 30 made of synthetic resin is formed to open the partition wall portion 17 provided on the upper main body case 7.

An opening area of the lattice-like intermediate exhaust air port 30 is smaller than an opening area of the main body exhaust air port 19, thereby the blower facility function of this embodiment of the present invention is enhanced. A filter member 31 made of urethane foam is provided on the lower side of the lattice-like intermediate exhaust air port 30 to reduce the exhaust air noise propagation from the motor driven blower receiving chamber 9.

The panel portion structure 16 and a blower facility structure 32 installed on the upper side of the concentration exhaust air chamber 12 will be explained with reference to FIGS. 8 and 13.

Figure 8:
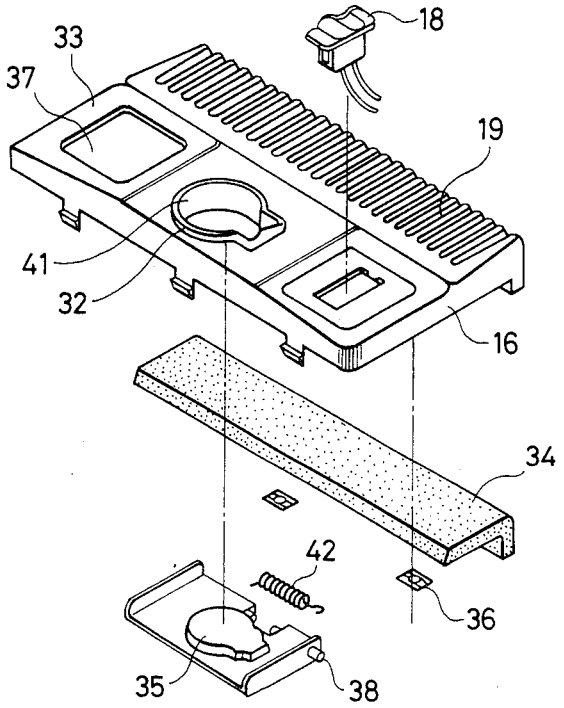
FIG. 8 shows an exploded perspective view of the panel portion structure of the vacuum cleaner including the blower facility structure.

FIG. 8 is an exploded perspective view of the panel portion structure 16. The panel portion structure 16 primarily includes the rear panel body 33 made of synthetic resin, a filter member 34 made of urethane foam and a generally plate-shaped blower facility valve body 35 integral with a valve body supporting member 50 made of synthetic resin. The power source switch 18 is as previously described inserted and fitted in an aperture 51, which is provided on the side of the panel main body 33.

The filter member 34 is provided at the back side of the main body exhaust air port 19. The filter member 34 is penetrated with a boss member (now shown) which projects from the panel main body 33, and is fixed by nuts 36 so as to prevent the filter member 34 from falling. An opening 37 for accommodating cord reel pedal is provided on another side of the panel main body 33.

Figure 9:
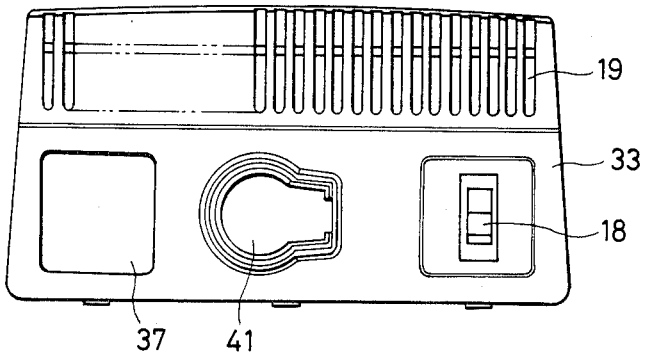
FIG. 9 shows a plan view of the panel portion structure of the vacuum cleaner.
Figure 10:
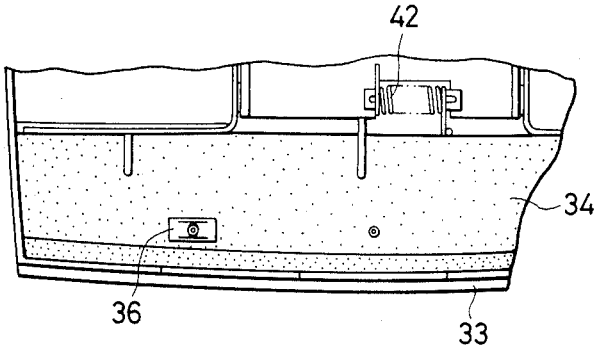
FIG. 10 shows a bottom view of the panel portion structure of the vacuum cleaner.
Figure 11:
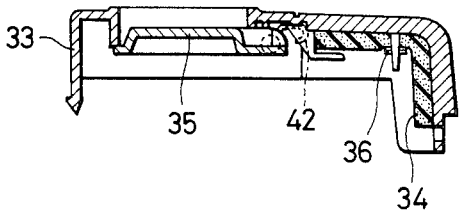
FIG. 11 shows a cross-sectional view of the panel portion structure of the vacuum cleaner.
Figure 12:
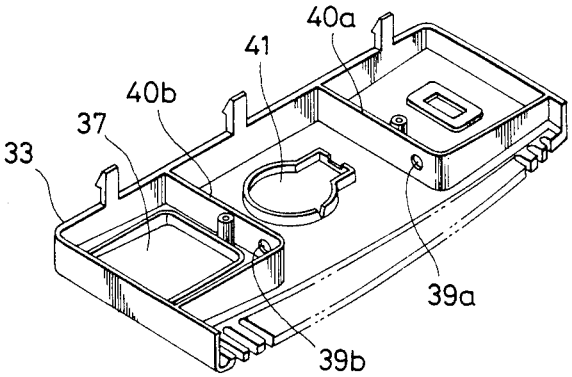
FIG. 12 shows a bottom view of the panel main body member of the vacuum cleaner.

The valve body supporting member 50 has a rotatable shaft 38. The shaft 38 is rotatably mated with shaft holes **39*a* and 39b provided on ribs 40a and 40b of the rear surface of the panel main body 33. The shaft 38 is normally urged by a tension spring 42 to close opening 41 provided on the central portion of the panel main body 33 for use with the blower facility. This described panel portion structure 16 is shown in FIGS. 9 to 11**.

The concentration exhaust air chamber 12 is surrounded by the lattice-like intermediate exhaust air port 30, wall surface portions 43 and 44 positioned on both sides of the lattice-like intermediate exhaust air port 30, and the panel main body 33.

The blower facility structure 32 in the present invention comprises the blower facility opening 41 of the panel main body 33, the blower facility valve body 35 and the torsion spring member 42. The blower facility opening 41 is normally closed by the blower facility valve body 35 when the blower facility structure 32 is not in use. The exhaust air passage is formed from the intermediate exhaust air port 30 from the motor driven blower mechanism 4 to the main body exhaust air port 19. However, the exhaust air passage formed from the intermediate exhaust air port 30 from the motor drive blower mechanism 4 to the blower facility opening 41 is closed.

Figure 14:
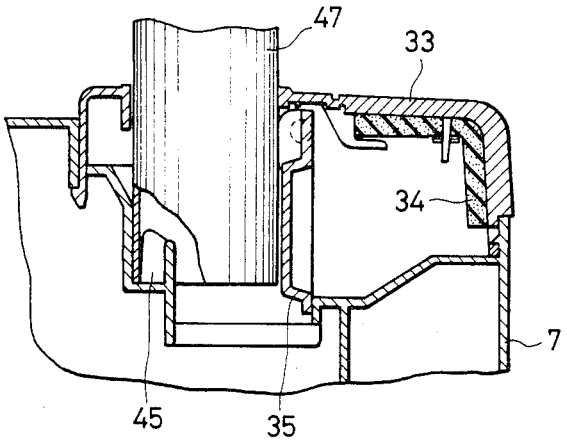
FIG. 14 shows a cross-sectional view in which the hose insert nozzle is inserted into the blower facility opening of the panel portion structure.

When the blower facility structure 32 is in use, an insert nozzle 47 (FIG. 14), which is attached at the tip of a hose, is inserted into the upper portion of the blower facility opening 41, thereby opening the blower facility valve body 35 gradually. The tip of the blower facility valve body 35 contacts the partition wall portion 17 at a fully open state as shown in FIG. 14 so as to shut the exhaust air passage between the intermediate exhaust air port 30 from the motor driven blower mechanism 4 and the main body exhaust air port 19 to the blower facility opening 41.

In the set condition of the nozzle 47 in the blower facility structure 32, the tip of the hose insert nozzle 47 is sandwiched by receiving rib 45 provided integrally on the partition wall portion 17 within the upper main body case 7. Thus, the hose insert nozzle 47 can be firmly installed.

Figure 13:
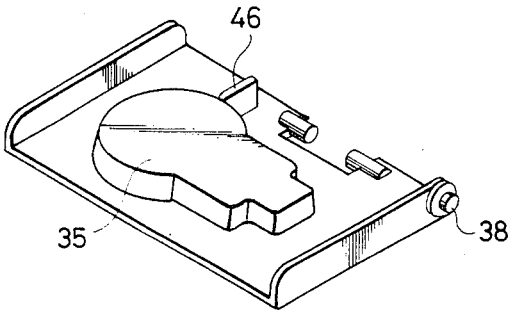
FIG. 13 shows a perspective view of the valve body supporting member of the vacuum cleaner.

As shown in FIG. 13, a rib 46 is integral with the valve body supporting member 50. The rib 46 is positioned at a position higher than the surface of the valve body supporting member. The tip of the hose insert nozzle 47 contacts and slides with the rib 46. As the rib 46 is provided at a position higher than the surface of the valve body supporting member 50, the surface of the blower facility valve body 35 does not directly contact the hose insert nozzle. 47. This prevents the surface of the bower facility valve body 35 from being grazed, scratched and the like.

Figure 15:
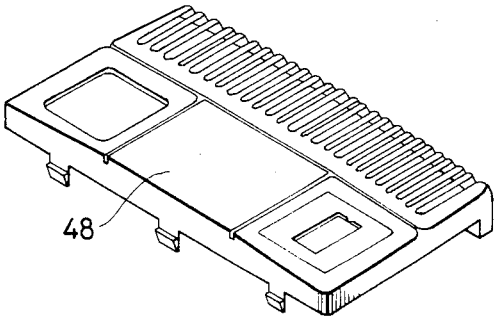
FIG. 15 shows a plan view of the panel main body member of the panel portion structure according to another embodiment of the present invention.

Another panel main body 48 used in the vacuum cleaner but without the blower facility structure, will be explained with reference to FIG. 15. A panel main body or a rear panel body 48 made of synthetic resin is constructed such that the blower facility opening 41 at the central portion is eliminated. This provides for series development of a line of vacuum cleaners merely by the selection of a panel main body 33 or a panel main body 48.

The blower facility valve body 35 provides the blower facility function and the main body exhaust air facility function. The blower facility valve body 35 is provided on the side of the panel portion structure 16. In the case of a vacuum cleaner without the blower facility structure, the panel main body 48, which covers the blower facility opening 32 is used, and the blower facility valve body 35 in the former embodiment is removed from the panel portion structure 16 as shown in FIG. 15.

The power source switch and the cord reel pedal can be provided on the panel main body 33. When several kinds of the panel portion structures are prepared in advance, a wide variety of series can be achieved to meet various situations merely by the selection of the desired panel portion structure.

The lattice-like intermediate exhaust air port 30 prevents the passing of extraneous substances by means of the lattice 29, even when the extraneous substances enter into the vacuum cleaner 1 from the blower facility opening 41 of the panel main body 33. Therefore, the extraeous substances hardly enter into the motor driven blower receiving chamber 9.

The exhaust air from the motor driven blower mechanism 4 flows into the concentration exhaust air chamber 12 and the main body exhaust air port 19 of the panel main body 33 via the exhaust air passage 14 being communicated with the lattice-like intermediate exhaust air port 30. The expansion and the compression of the exhaust air flow in the above-mentioned structure advantageously reduces exhaust air noise.

We claim:

1. A vacuum cleaner comprising, a main body case having a motor driven blower mechanism and a cord reel mechanism therein, a dust case having a dust collector apparatus therein, and a panel portion structure provided on said main body case, wherein said panel portion structure including a panel main body member and a blower facility valve body member, said panel main body member has a main body exhaust air port and an opening for a blower facility, said blower facility valve body member is provided at a lower side of said panel main body member and is pivotally supported so as to normally close said blower faiclity opening, a first exhaust air passage is formed from an exhaust air passage from said motor driven blower mechanism to said main body exhaust air port, a second exhaust air passage is formed from said exhaust air passage from said motor driven blower mechanism to said blower facility opening, and said blower facility valve body member is operable to change over from said first exhaust air passage to said second exhaust air passage.

2. A vacuum cleaner comprising, a main body case having a motor driven blower mechanism and a cord reel mechanism therein, a dust case having a dust collector apparatus therein, and a panel portion structure provided on said main body case, wherein a partition wall portion having an intermediate exhaust air port, said intermediate exhaust air port is provided at an intermediate portion of an exhaust air passage from said motor driven blower mechanism, said panel portion structure includes a panel main body member and a blower facility valve body member, said panel main body member has a main body exhaust air port and an opening for a blower facility, said blower facility valve body member is provided at a lower side of said panel main body member and supported rotatably so as to normally close said blower facility opening of said panel main body member, a first exhaust air passage is formed from said intermediate exhaust air port to said main body exhaust air port, a second exhaust air passage is formed from said intermediate exhaust air port to said blower facility opening, and said blower facility valve body member is operable to change over from said first exhaust air passage to said second exhaust air passage.

3. A vacuum cleaner according to claim 2, wherein said intermediate exhaust air port has a lattice-like form.

4. A vacuum cleaner according to claim 3, wherein an opening area of said intermediate exhaust air port of lattice-like form is smaller than an opening area of said main body exhaust air port.

5. A vacuum cleaner according to claim 3, wherein a filter member is provided at a lower portion of said intermediate exhaust air port.

6. A vacuum cleaner according to claim 3, wherein said blower facility opening is provided at a central portion of said panel main body member.

7. A vacuum cleaner according to claim 3, wherein a power source switch portion is provided at a side portion of said panel main body member.

8. A vacuum cleaner according to claim 3, wherein an opening for a cord reel pedal is provided at a side portion of said panel main body member.

9. A vacuum cleaner according to claim 2, wherein said blower facility valve body member is provided on a valve body supporting member, said valve body supporting member is rotatably supported at a lower side of said panel main body member, and spring means is associated with said blower facility valve body member for normally pressing said member toward said blower facility opening to a closed state of the opening.

* * * * *